United States Patent [19]

Watanabe et al.

[11] 4,434,002

[45] Feb. 28, 1984

[54] PROCESS FOR PRODUCTION OF HIGH-PURITY METALLIC IRON

[75] Inventors: Morio Watanabe, Hyogo; Sanji Nishimura, Kyoto, both of Japan

[73] Assignee: Solex Research Corporation of Japan, Tokyo, Japan

[21] Appl. No.: 294,538

[22] Filed: Aug. 20, 1981

[30] Foreign Application Priority Data

Aug. 29, 1980 [JP] Japan ..... 55-119308

[51] Int. Cl.[3] ..... C01G 49/00; C01G 49/10

[52] U.S. Cl. ..... 75/0.5 AA; 75/0.5 BA; 75/108; 75/29; 75/34; 423/139; 423/351

[58] Field of Search ..... 75/0.5 BA, 0.5 AA, 108, 75/29, 34; 423/139, 351

[56] References Cited

U.S. PATENT DOCUMENTS 2,167,784 8/1939 Svendsen ..... 423/633

3,666,446 5/1972 Cook ..... 423/24

4,172,879 10/1979 Miller ..... 423/139

FOREIGN PATENT DOCUMENTS 3012246 10/1980 Fed. Rep. of Germany ..... 423/139

OTHER PUBLICATIONS

Agers, *Mining Engineering*, Dec. 1965, pp. 76–80.

Wells, *Nuclear Science and Engineering* 17 (1963) pp. 259–267.

Mellor, *Inorganic and Theoretical Chemistry*, Longmans Green, N.Y. (1935) vol. XIV, pp. 2–7.

*Primary Examiner*—Edward J. Meros

*Assistant Examiner*—Robert L. Stoll

*Attorney, Agent, or Firm*—Toren, McGeady and Stanger

[57] ABSTRACT

A process for production of metallic iron by heating ammonium iron fluoride or iron fluoride in a hydrogen stream.

1 Claim, 5 Drawing Figures

PROCESS FOR PRODUCTION OF HIGH-PURITY METALLIC IRON

BACKGROUND OF THE INVENTION

1. Field of the Invention:

This invention relates to a process for production of high-purity metallic iron.

2. Description of the Prior Art:

The conventional process for production of high-purity metallic iron has been mostly an electrolytic refining process which electrodeposits high-purity iron on a cathode plate in a sulphuric acid or hydrochloric acid bath using a comparatively high-purity metallic iron, for example a mild steel, as an anode.

However, the following disadvantages are found in the conventional electrolytic process.

(1) Electrolysis in strong acids, such as electrolysis of zinc is impossible because iron ion is a more base metallic iron than $H^+$ ion and has a low hydrogen overvoltage;

(2) Operational control of electrolytic bath is difficult;

(3) Maintenance of electrolytic bath over 3 of pH value precipitates iron hydroxide to cause oxidation of $Fe^{2+}$ ion;

(4) Intrusion of any nobler metal ions than iron ion, such as copper ion, into the electrolytic bath cannot yield high-purity metallic iron;

(5) Dendritic electrodeposit of deposited metallic iron on the cathode often prohibits continuation of successive electrolysis or hinders a high current efficiency; and (6) Large amounts of power and labor required for finely grinding metallic iron electrodeposited on the cathode plate into particles under 40μ in hydrogen or inert gas stream to obtain high-purity iron powder increase the production cost of high-purity metallic iron and thus limiting its application field.

DETAILED DESCRIPTION OF THE PREFERRED EMBODIMENTS

This invention provides a process for producing metallic iron by thermal decomposition of ammonium iron fluoride or iron fluoride in hydrogen gas stream in order to overcome the disadvantages of the conventional process described above, particularly the difficulty of operational control and the high production cost, etc.

The particle size of high-purity metallic iron produced by this invention is determined by the crystalline size of ammonium iron fluoride or iron fluoride prior to their thermal decomposition.

Ammonium iron fluoride, in particular, has a high crystal velocity so that it is possible to produce metallic iron powder having consistent high purity and consistent particle size through repetition of recrystallization of ammonium iron fluoride.

Moreover, raw materials used in the present invention are not specially limited since any aqueous solution containing iron ions is possible to be used in combination with solvent extraction technique and the production cost of high-purity metallic iron is lowered, because raw materials obtained from waste acids from steel pickling processes, as well as sludges and residues from nonferrous extractive metallurgy can be advantageously used.

The following treatment as one example is preferable for obtaining ammonium iron fluoride or iron fluoride as a raw material used in the present invention. For example, Fe ions are extracted into an organic phase of an organic solvent containing one or more compounds selected from the group of alkyl phosphoric acid, alkyl or aryl dithio phosphoric acid, carboxylic acid and hydroxime together with a petroleum hydrocarbon as a diluent, the resultant organic solution is brought into contact with a stripping agent containing one or more compounds selected from HF, $NH_4HF_2$ and $NH_4F$ to form ammonium iron fluoride or iron fluoride through the following equation and then those are filtrated out.

$$R_3.Fe + 3HF \rightleftharpoons 3R.H + FeF_3 \downarrow$$

$$R_3.Fe + 3NH_4HF_2 \rightleftharpoons 3R.H + (NH_4)_3FeF_6 \downarrow$$

$$R_3.Fe + 6NH_4F \rightleftharpoons 3R.NH_4 + (NH_4)_3FeF_6 \downarrow$$

where R.H indicates a proton type extractant.

Ammonium iron fluoride defined by this invention is not limited to be in the form of $(NH_4)_3FeF_6$, but it involves various compositions containing different ratios of $NH_4^+$ ion to $F^-$ ion or mixed crystals of iron fluoride and ammonium iron fluoride.

It is preferable to use the following aqueous solutions for stripping iron ions in the organic solvent;

(1) Solutions containing not less than 40 g/l of HF;

(2) Solutions containing not less than 30 g/l of $NH_4F$; and (3) Solutions containing not less than 40 g/l of $NH_4HF_2$.

The aqueous solutions usable for extraction of Fe ions from the solutions containing them for preparation of ammonium iron fluoride or iron fluoride utilized in this invention are those containing HCl, $HNO_3$, $H_2SO_4$ and $HNO_3$+HF. Extraction of Fe ions from strong acids below zero of pH value is advantageous because therefrom of heavy metal ions other than Fe ion is negligible.

Of course Fe ions can be extracted from aqueous solutions of pH values from 2 to 6.

$Fe^{3+}$ ions extracted into the organic solvent can be stripped into the aqueous phase with contact of strong acids from 4 to 6 N HCl or mineral acids of relative low concentration after the valency conversion from $Fe^{3+}$ ion to $Fe^{2+}$ ion with contact of reducing substances. However, the above conventional stripping process has a disadvantage of high operating cost. The present inventors accomplished this invention as a result of investigation of various economical stripping processes of $Fe^{3+}$ ions. The extractants usable to extract Fe ions in this invention are as follows.

The extractant of alkyl phosphoric acid group is selected from the compounds (A)–(F) shown below:

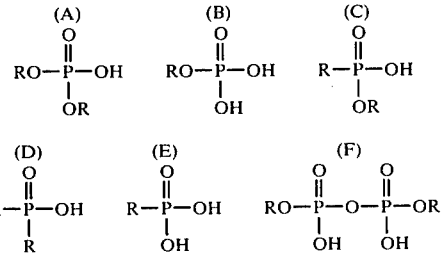

where R is alkyl radical containing 4 to 14 carbon atoms. D2EHPA (di-2-ethyl hexyl phosphoric acid)

shown in the example set forth hereinafter belongs to the (A) group having alkyl radical of $C_8H_{17}$.

The extractant of alkyl or aryl dithio phosphoric acid group used in this invention includes the compounds shown below:

(G)

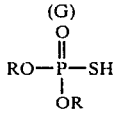

where R is alkyl or aryl radical having 4 to 18 carbon atoms. D2EHDTPA (di-2-ethyl hexyl dithio phosphoric acid) shown in the example set forth hereinafter has alkyl radical of $C_8H_{17}$.

The extractants of carboxylic acid group used in this invention includes the compounds shown below:

(H)

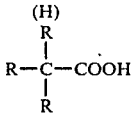

(I)

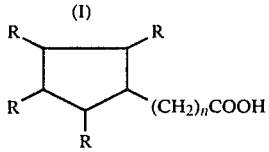

where R is alkyl radical having 4 to 18 carbon atoms. Versatic acid 10 (V-10) (tradename, produced by Shell Chemical Co.) shown in the example belongs to the (H) group having alkyl radical of 9 to 11 carbon atoms.

The extractant of hydroxime used in this invention includes the compound shown below:

(J)

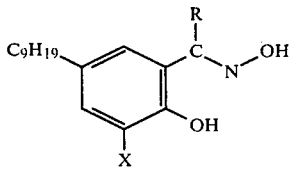

where R is

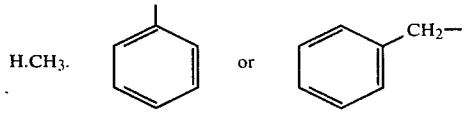

and X is Cl or H. Similar hydroximes can be naturally used.

SME-529 (tradename, produced by Shell Chemical Co.) used in the example is a hydroxime in which $R{=}CH_3$.

The petroleum hydrocarbon used in this invention is alphatic, aromatic hydrocarbon or mixture of these compounds. The commercial mixture of various hydrocarbons such as kerosene is often used.

Although the concentration of extractant in the organic solvent is determined according to Fe ion concentration and kind or concentration of anion and heavy metal ions extracted other than Fe ions in the solution to be treated, it usually lies in the range of 2 to 90 volume %.

Ammonium iron fluoride and iron fluoride used as a raw material in this invention can be produced from following various sources.

Fe ions in aqueous solutions from Fe removal process in nonferrous extractive hydrometallurgy, waste acids from surface treatment processes of metallic materials and products or various solutions ejected from resource recovery processes, Fe values in these sources are extracted into the organic phase with contact of an adequate organic extractant.

Then, Fe ions in the resultant organic solution are stripped with contact of the aqueous solution containing HF, $NH_4HF_2$, or $NH_4F$ to form ammonium iron fluoride or iron fluoride.

The present invention will be described in more detail with reference to the attached drawings. Of course, the present invention is not limited to the following description of embodiments.

BRIEF DESCRIPTION OF THE DRAWINGS

As shown in FIG. 1, the raw material (A) of ammonium iron fluoride and iron fluoride is fed to the thermal decomposition process (B) to obtain metallic iron (C) by thermal decomposition of the raw material in hydrogen gas stream at temperature of 380° to 400° C., in which the thermal decomposition reaction starts at about 200° C. and finishes below 580° C. $NH_4F$, HF, F, $NH_3$ and $NH_4HF_2$ gases generated in the thermal decomposition process are absorbed and recovered into water in the absorption process (D).

Figure 1:
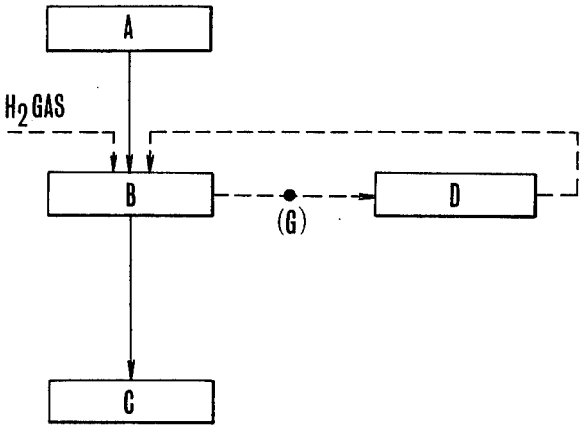
FIG. 1 shows a flow-sheet of the process according to the present invention.
Figure 2:
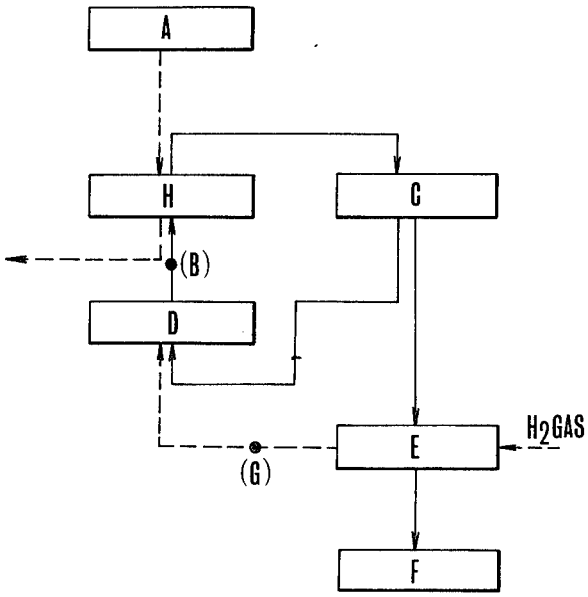
FIG. 2 shows a flow-sheet of the process for producing high-purity metallic iron from an organic solvent into which Fe ions have been extracted.

The flow-sheet shown in FIG. 2 illustrates production of high-purity metallic iron from Fe ions extracted into the organic solvent. The organic solvent (A) containing Fe ions is stripped with the stripping solution (B) containing $NH_4HF_2$, HF and $NH_4F$ in the stripping process (H), ammonium iron fluoride or iron fluoride is obtained in the following separation process (C) and metallic iron (F) is produced by heating them in hydrogen gas stream in the thermal decomposition process (E). $NH_4F$, HF, F, $NH_3$ and $NH_4HF_2$ gases (G) generated in the thermal decomposition process are absorbed into water in the absorption process (D) and reused for stripping Fe ions extracted into the organic solvent.

The present invention has the following advantages.

(1) Application of high-purity iron in electronic or corrosion resistant materials is enlarged owing to the low cost and easy preparation.

(2) Removal of iron in nonferrous extractive hydrometallurgy can be economically carried out and recovery efficiency can be enhanced by controlling a loss of other coexisting metals.

(3) The present invention can be applied for treating industrial wastes containing large amounts of iron and other valuable metals, yielding commercial values of iron and hence realizing enlargement of recycling industry.

(4) When applied for recovery of waste acids used for surface treatments of metallic materials and products, the present invention facilitates control of the pickling process and hence increases acid recovery efficiency.

DETAILED DESCRIPTION OF THE PREFERRED EMBODIMENTS

The following examples are based on the experiments carried out by the inventors.

EXAMPLE 1

Figure 3:
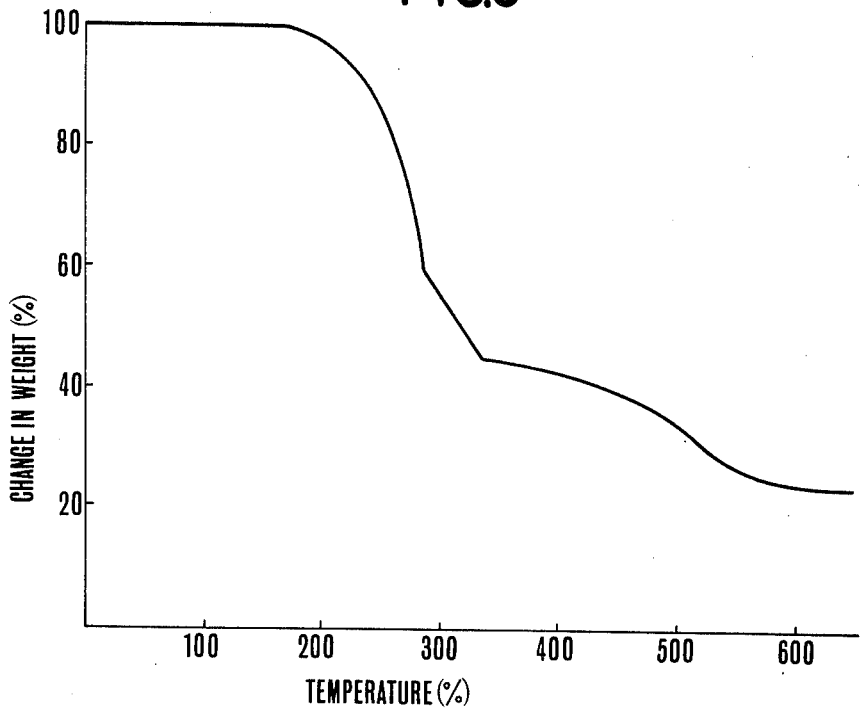
FIG. 3 is a graph showing the relation between the thermal decomposition (weight changes) of ammonium iron fluoride in hydrogen stream and the temperature.

The thermal decomposition curve was investigated by heating gradually 100 mg of ammonium iron fluoride [$(NH_4)_3FeF_6$] in hydrogen gas stream. The observed change of weight at a temperature rising rate of 7° C./min. is shown in FIG. 3.

Metallic iron of 24 mg having certified purity of 99.9999% up was quantitatively obtained by heating up to 600° C. Moreover, the results of repeated tests showed that metallic iron is produced by thermal decomposition in hydrogen gas stream at 350° C. The ammonium iron fluoride used in this example was prepared by the following process.

Fe ions in inorganic acids are extracted into an organic solvent comprising 30% D2EHPA as an extractant together with 70% isoparaffine as a diluent and then crystalline ammonium fluoride is precipitated by contacting the resultant organic solution with a stripping solution containing 100 g/l of $NH_4HF_2$ and filtrated out. This ammonium iron fluoride is washed successively with isopropyl alcohol, ethanol and acetone, in that order and is allowed to cool in a desicator maintained at 110° C. for one hour.

Analysis of this sample after HCl dissolution is shown below:

| | Fe | F | $NH_4$ | $H_2O$ |
|---|---|---|---|---|
| Mole number | 1 | 5.72 | 2.68 | 0.88 |
| Mole ratio | 1 : | 6 : | 3 : | 1 |

The thermal decomposition of ammonium iron fluoride to metallic iron may be expressed by the following reaction equation, but the present invention should not be limited to this reaction.

$$(NH_4)_3FeF_6.H_2O+3/2H_2 \rightleftarrows 3NH_4F+3HF+H_2O+Fe$$

Although D2EHPA is used as the extractant in this example, $(NH_4)_3FeF_6$ can be obtained by stripping other organic solvents can extract the iron ions with the stripping solution containing $NH_4HF_2$. Example is shown in Table 1. Stripping conditions are as follows:

Stripping agent: 100% $NH_4HF_2$

Temperature: 28.5° C.

Contact time: 10 minutes O/A=1.0

TABLE 1

| Concentration of extractant | 50% OPPA | 40% V-10 | 20% D2EHPA + 30% OPPA* |
|---|---|---|---|
| Fe concentration in organic phase after stripping | 0.2 g/l | <0.01 g/l | 0.3 g/l |
| Stripping percentage | 97.1% | about 100% | 90.7% |
| Concentration of extractant | 30% D2EHDTPA | 10% OPPA + 30% V-10 | 10% SME-529** + 30% D2EHPA |
| Fe concentration in organic phase after stripping | 1.4 g/l | <0.01 g/l | 0.3 g/l |
| Stripping percentage | 79.7% | about 100% | 89.6% |

*OPPA (octyl phenol phosphoric acid)

**SME-529 (tradename, produced by Shell Chemical Co., hydroxime)

Figure 4:
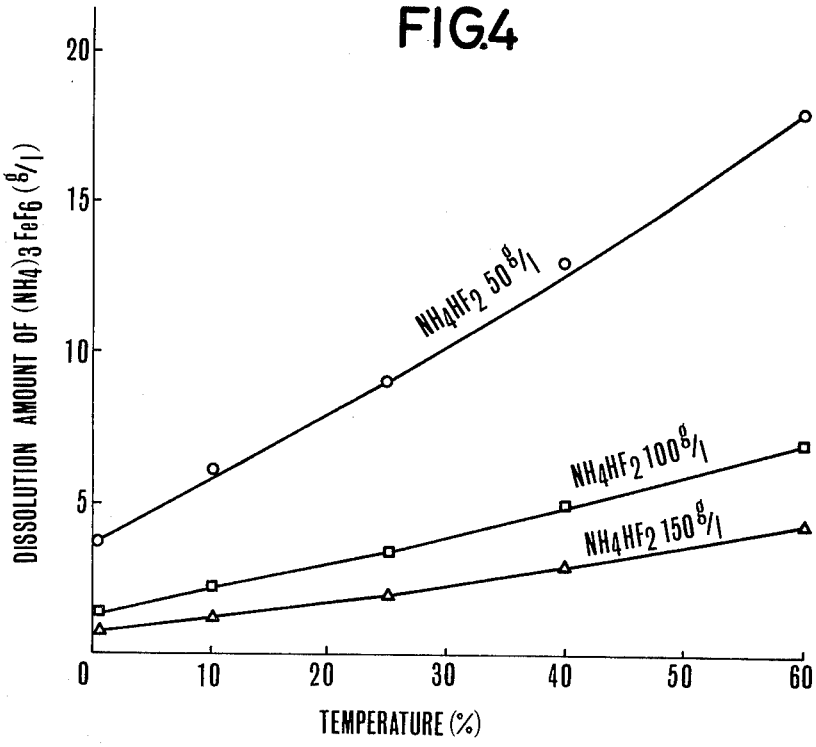
FIG. 4 is a graph showing the relation between the dissolution of $(NH_4)_3FeF_6$ in various solutions and the temperature.
Figure 5:
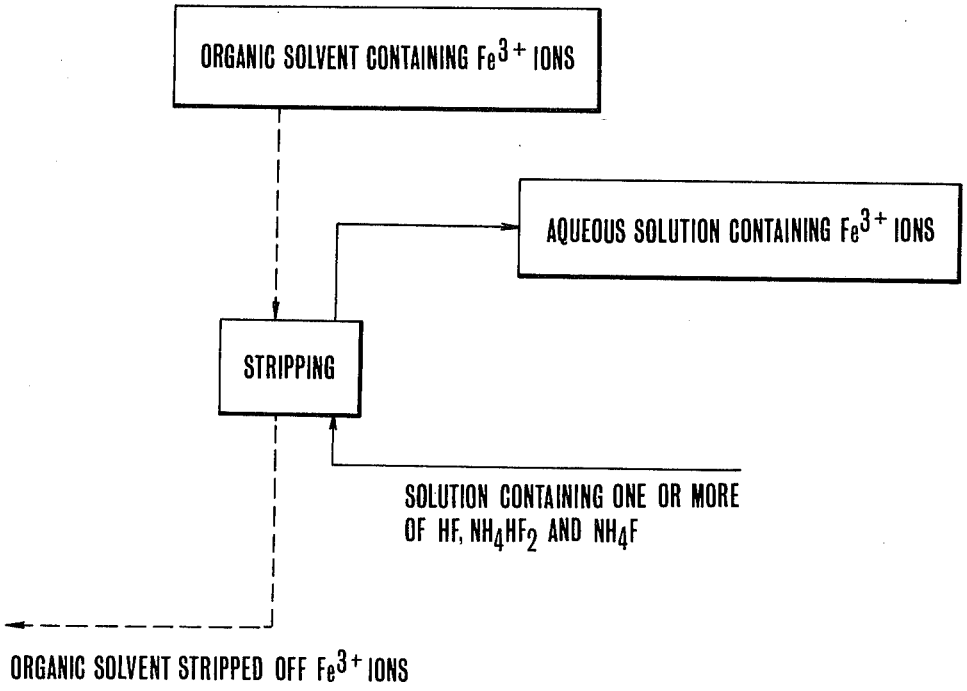
FIG. 5 is a flow-sheet for a process in which $Fe^{3+}$ ions extracted into an organic solvent are stripped into an aqueous solution.

It is proved from analysis that the precipitate obtained by these operations is ammonium iron fluoride. As shown in FIG. 4, the solubility of ammonium iron fluoride is dependent on the concentration of $NH_4HF_2$ and consequently the total amount of iron stripped from the organic phase does not convert into the precipitate of ammonium iron fluoride.

EXAMPLE 2

Fe ions in the organic solvent can be transferred into the aqueous phase with contact of an aqueous solution containing only HF, as shown in the following expression.

$$R_3Fe+3HF \rightleftarrows 3RH+FeF_3 \downarrow$$

HF concentration of not lower than 40 g/l is suitable for precipitation of $FeF_3$. The thermal decomposition by heating of the obtained $FeF_3$ begins at around 280° C. in hydrogen gas stream and the reaction finishes before the temperature reaches 600° C. The thermal decomposition reaction may be considered to proceed by the following equation.

$$FeF_3+3/2H_2 \rightleftarrows 3HF+Fe$$

HF gas generated in the thermal decomposition is absorbed with water, just as the ammonium iron fluoride, and reused for stripping iron ions in the organic phase.

$FeF_3$ used in this example is prepared by the following process. $Fe^{3+}$ ions in an aqueous solution are extracted into an organic solvent comprizing 30 volume % D2EHPA together with isoparaffine as a diluent and then crystalline iron fluoride is precipitated by contacting the resultant organic solution with stripping solutions containing 50 g/l HF, 75 g/l HF and 100 g/l HF, respectively. Example is shown in Table 2.

TABLE 2

| Stripping agent | Extractant | | |
|---|---|---|---|
| | 30% V-10 | 30% D2EHPA | 30% D2EHDTPA |
| HF 50 g/l | <0.1 g/l (about 100%) | 1.2 g/l (61.4%) | 1.55 g/l (20.4%) |
| HF 75 g/l | <0.1 g/l (about 100%) | 0.1 g/l (96.8%) | 1.0 g/l (53.2%) |
| HF 100 g/l | <0.1 g/l (about 100%) | <0.1 g/l (about 100%) | 0.15 g/l (92%) |

Stripping conditions

Contact time: 10 minutes O/A=1.0

Values indicate iron content in the organic phase after stripping.

As shown in Table 2, V-10 and D2EHDTPA as an extractant besides D2EHPA can be used for preparation of $FeF_3$. Furthermore, $FeF_3$ can be prepared as a white precipitate by an alternative process in which a raw material containing iron is dissolved into an aqueous solution involving HF followed by an oxidation process. This white precipitate is analysed as $FeF_3.nH_2O$. As described above, the preparation of $FeF_3$ and $(NH_4)_3FeF_6$ is not limited to the solvent extraction technique.

The present invention is applicable to a process for production of metallic iron by heating ammonium iron fluoride or iron fluoride prepared by optional methods in hydrogen gas stream.

Moreover, this invention provides a process for production of metallic iron according to the following sequential steps:

(1) The first step in which Fe ions in optional aqueous solutions are extracted into an organic phase with contact of an organic solvent containing one or more compounds selected from the group of alkyl phosphoric acid, alkyl or aryl dithio phosphoric acid, carboxylic acid and hydroxime together with a petroleum hydrocarbon as a diluent.

(2) The second step in which ammonium iron fluoride or iron fluoride is obtained by stripping Fe ions in the resultant organic solution with a stripping agent containing one or more compounds selected from HF, $NH_4HF_2$ and $NH_4F$.

(3) The third step in which metallic iron is produced by heating the resultant ammonium iron fluoride or iron fluoride from the second step in hydrogen gas stream.

It is noted that if the aqueous solution into which $NH_4F$, $NH_3$, HF and F gas generated in the thermal decomposition have been absorbed is recycled and reused for stripping Fe ions in the organic phase, it facilitates the concentration control of the aqueous solution containing HF and $NH_4HF_2$, the water balance and the recycling in comparison with another method in which ammonium iron fluoride or iron fluoride is directly obtained by dissolution of raw materials containing iron with aqueous solution containing HF or $NH_4HF_2$.

What is claimed is:

1. A process for the production of metallic iron comprising producing ammonium iron fluoride by:

(a) extracting the iron ions from an aqueous solution thereof with an organic solvent containing one or more compounds selected from the group consisting of alkyl phosphoric acid, alkyl or aryl dithio phosphoric acid, carboxylic acid and hydroxime together with a petroleum hydrocarbon as a diluent;

(b) producing ammonium iron fluoride by stripping the resultant organic solvent from the preceding step by contact with an aqueous solutuion containing one or more compounds selected from the group of $NH_4HF_2$ and $NH_4F$, and (c) heating the ammonium iron fluoride in a hydrogen stream to produce metallic iron.

* * * * *